US006607037B2

(12) United States Patent
Thompson

(10) Patent No.: US 6,607,037 B2
(45) Date of Patent: Aug. 19, 2003

(54) SAND CONTROL SEAL FOR SUBSURFACE SAFETY VALVE

(75) Inventor: Grant R. Thompson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/912,689

(22) Filed: Jul. 24, 2001

(65) Prior Publication Data

US 2003/0019629 A1 Jan. 30, 2003

(51) Int. Cl.[7] ..... E21B 34/14

(52) U.S. Cl. ..... 166/332.1; 166/319; 166/320; 166/321; 166/332.8; 166/334.1

(58) Field of Search ..... 166/332.1, 332.8, 166/334.1, 319, 320, 321

(56) References Cited

U.S. PATENT DOCUMENTS 3,763,933 A * 10/1973 Mott ..... 166/224 S
3,786,863 A 1/1974 Tausch
3,799,258 A 3/1974 Tausch
4,460,046 A 7/1984 Pringle
4,475,598 A 10/1984 Brakhage, Jr. et al.
4,569,398 A * 2/1986 Pringle ..... 166/321
4,597,445 A 7/1986 Knox
5,058,682 A 10/1991 Pringle
5,411,096 A 5/1995 Akkerman

FOREIGN PATENT DOCUMENTS

GB 2334540 A 8/1999

* cited by examiner

*Primary Examiner*—Lynne H. Browne
*Assistant Examiner*—G M Collins
(74) *Attorney, Agent, or Firm*—Steve Rosenblatt

(57) ABSTRACT

A seal is provided to prevent contamination by sand or grit in the clearance between a flow tube and the inner housing wall in a safety valve. An enlarged space is provided adjacent the seal to allow accumulation of sand or grit in the annular clearance space without causing seizure of the flow tube. The insert safety valve is assembled without a spacer with a seal mounted to the lower end of the insert valve to engage the bottom sub on the SSV. As a result, particularly for larger sizes of insert safety valves, the assembly is lighter and shorter, which facilitates use of readily available standard lubricator and wireline equipment.

15 Claims, 3 Drawing Sheets

SAND CONTROL SEAL FOR SUBSURFACE SAFETY VALVE

FIELD OF THE INVENTION

The field of this invention is subsurface safety valves and more particularly, sand seals for insert safety valves, generally installed on wireline.

BACKGROUND OF THE INVENTION

Production tubing generally includes a subsurface safety valve (SSV) as part of the string. If the SSV malfunctions, an insert safety valve can be lowered through the tubing string, generally on a wireline, so that it seats in a pair of seal bores which permit the existing hydraulic control line system for the tubing SSV to be used in operation of the insert safety valve. The downhole safety valves previously used employed a shifting flow tube actuated by an annularly shaped piston using the hydraulic pressure in the control line. The piston would move against the opposing force of a return spring. Downward movement of the flow tube would rotate a flapper 90 degrees and away from a mating seat to allow flow to pass uphole through the flow tube. The piston resided in an annular recess in the housing formed between an inner wall and an outer wall. The flow tube was positioned inwardly of the inner wall leaving a clearance. The clearance was necessary to allow the flow tube to freely translate, as needed to open or close the SSV or the similarly operating insert safety valve.

In operation, applied pressures in the hydraulic control system had to exceed the operating tubing pressures to stroke the flow tube downwardly. In some instances, the applied control pressure was sufficient to flex the inner housing wall. Since the gap existed between the flow tube and the inner housing wall by design and well fluids could migrate into that gap, the flexing of the inner housing wall could cause seizure of the flow tube particularly when sand or grit was present in the well fluids. One solution that has been attempted is to enlarge the clearance between the flow tube and the housing inner wall. The disadvantage of this approach was that it would allow more sand and grit to reach sensitive areas such as the seals for the actuating piston. Accumulations in this sensitive seal area soon would cause a piston seal failure or seizure of the actuating piston. Another approach was to increase the wall thickness of the inner housing wall to minimize its deflection in response to applied control system pressures, which exceeded tubing pressure. However, this approach had the drawback of decreasing the flow tube bore size, which could impede production or limit the size of tools that could pass through the flow tube.

Another problem with insert safety valves when installed on wireline, particularly when it comes to large sizes such as 9⅝" is the weight and length of the assembly. In the past, spacers and locks associated with an insert valve, particularly in the large sizes would constitute an assembly whose weight could exceed the capability of the wireline. Additionally, the length of large size assemblies could exceed the available length in a surface lubricator. This could necessitate the use of non-conventional lubricators, which added expense. The undue length could also be an issue in a deviated well where a potential of getting the insert valve assembly stuck existed.

The present invention has as one of its objectives the ability to effectively exclude or at least minimize the adverse effect of sand or grit in the clearance between the flow tube and the inner housing wall. This objective is accomplished without the disadvantages of the prior attempts described above. Another objective of the invention is to shorten the assembly length and weight so as to facilitate delivery of an insert valve with standard wireline equipment and lubricators. Those skilled in the art will appreciate how these objectives are met by a review of the description of the preferred embodiment, which appears below.

SUMMARY OF THE INVENTION

A seal is provided to prevent contamination by sand or grit in the clearance between a flow tube and the inner housing wall in a safety valve. An enlarged space is provided adjacent the seal to allow accumulation of sand or grit in the annular clearance space without causing seizure of the flow tube. The insert safety valve is assembled without a spacer with a seal mounted to the lower end of the insert valve to engage the bottom sub on the SSV. As a result, particularly for larger sizes of insert safety valves, the assembly is lighter and shorter, which facilitates use of readily available standard lubricator and wireline equipment.

DETAILED DESCRIPTION OF THE PREFERRED EMBODIMENT

Figure 1:
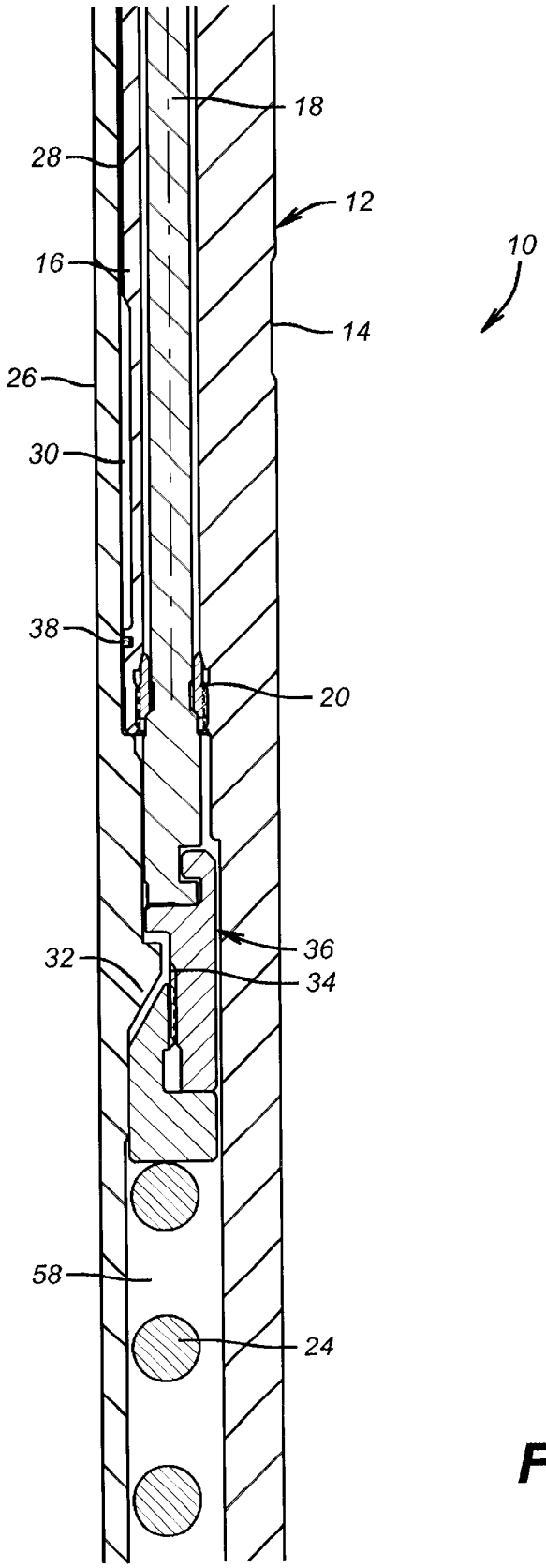
FIG. 1 is a sectional elevation view of that portion of a safety valve showing the placement of the sand control ring.

Referring to FIG. 1, a portion of an SSV 10 is shown. The illustration is equally apt for a tubing mounted SSV as well as an insert safety valve and reference to SSV is intended to encompass either or both types. A housing 12 has an outer wall 14 and an inner wall 16. A rod shaped piston 18 occupies the annular space formed between walls 14 and 16. Ring 20 is stationary and acts as a travel stop to piston 18 and, with a rod piston seal (not shown) mounted above, pressure from a control line (not shown) builds up in the housing 10 above piston 18. The present invention is equally applicable in the case of an annularly shaped piston, as with a rod piston design illustrated in the Figures. The built up pressure moves piston 18 downwardly against the bias of return spring 24. The flow tube 26 is mounted inside the inner wall 16 leaving a clearance 28 in between. The clearance 28 features and enlarged volume 30 which can be created by a recessed surface on the inner wall 16, as shown, or alternatively, the flow tube 26 or both opposed members can have a recess to enlarge the clearance 28. Further down the flow tube 26 has a shoulder 32, which extends into a receptacle 34 on sleeve 36. Sleeve 36 is attached to piston 18, such that downward movement of piston 18 responsive to control line pressure also moved the flow tube 26 downwardly as receptacle 34 pushes down on captured shoulder 32. Spring 24 is compressed in this process so that it can provide the closure force during normal or emergency closure, in a manner known in the art.

Figure 2:
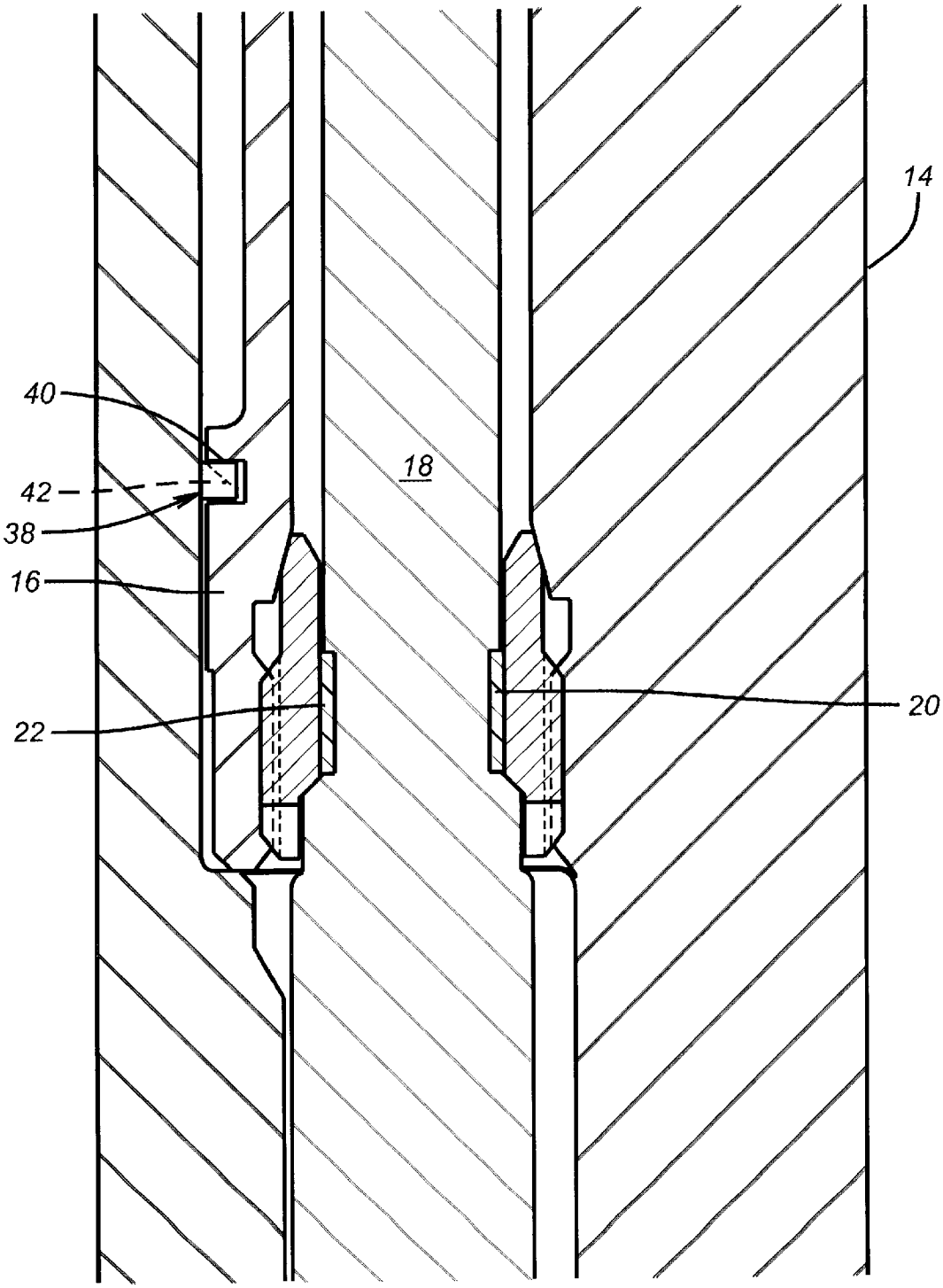
FIG. 2 is an enlarged view of the sand control ring and its mounting groove.

FIG. 2 illustrated in greater detail the sand control ring 38 installed in groove 40 in inner wall 16. The purpose of ring 38 is to minimize or prevent solids from the wellbore from passing around it and reaching the piston 18 or the seals 20 and 22. To ease assembly into groove 40, the ring 38 can have a split 42 (shown schematically in dashed lines in FIG. 2). Ring 38 preferably floats freely in groove 40. Despite that, the axial clearances are sufficiently small as to minimize or prevent particulate passage around the flanks of ring 38. The depth of groove 40 is designed to be sufficient so that any flexing of inner wall 16 will not bring the bottom of groove 40 against the outer diameter of the ring 38. Such flexing can occur from pressures in excess of tubing pressure applied through the control line (not shown), which causes the inner wall 16 to move toward the flow tube 26. The ring 38 is preferably made of Elgiloy, which is a cobalt-chromium-nickel alloy selected for its corrosion resistance. Alternative materials, such as any spring wire material can also be substituted. The ring 38 needs sufficient rigidity, thermal stability, and chemical compatibility for the intended service. It needs to consistently contact the flow tube 26, while floating in groove 40, to function optimally. The split 42 can be on an angle to facilitate insertion of the ring 38 into groove 40. The enlarged volume 30 serves as a chamber for accumulated particulates adjacent ring 38 to prevent or minimize bridging of such particulates between inner wall 16 and flow tube 26.

It should be noted that the annular space 58 in which spring 24 resides has a clearance gap (not shown) in the area of the flapper (not shown). A clearance gap is workable in that region because the housing 12 is stouter in that section and deflection is not an issue as it is in the area of ring 38. There is also a greater tendency of solids infiltration at the top of the flow tube 26 than at its bottom. Some clearance is also needed adjacent the annular space 58 to prevent collapse of the flow tube 26 if there is pressure in annular space 58 and the tubing pressure is rapidly relieved. Seals have not previously been used at the lower end of flow tube 26 to isolate the lower end of annular space 58.

Figure 3:
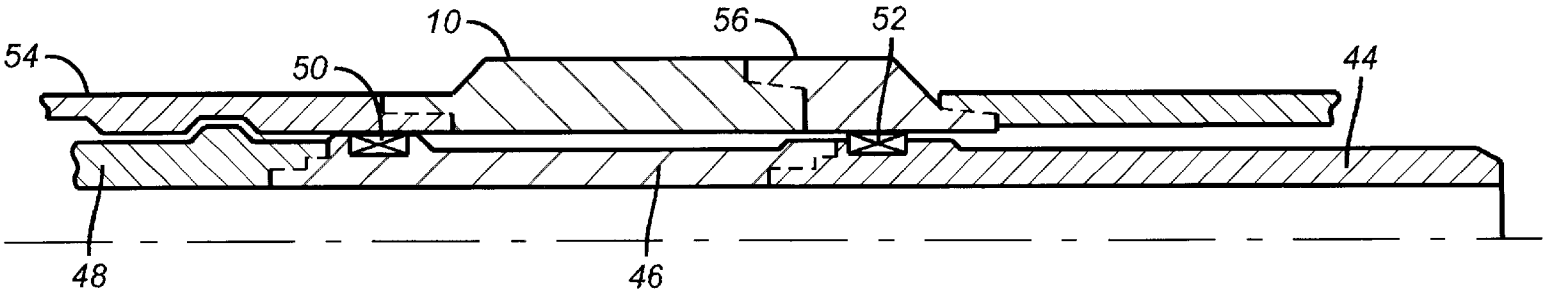
(PRIOR ART) FIG. 3
FIG. 3 is a sectional view of the prior art installation of an insert valve into an SSV.
Figure 4:
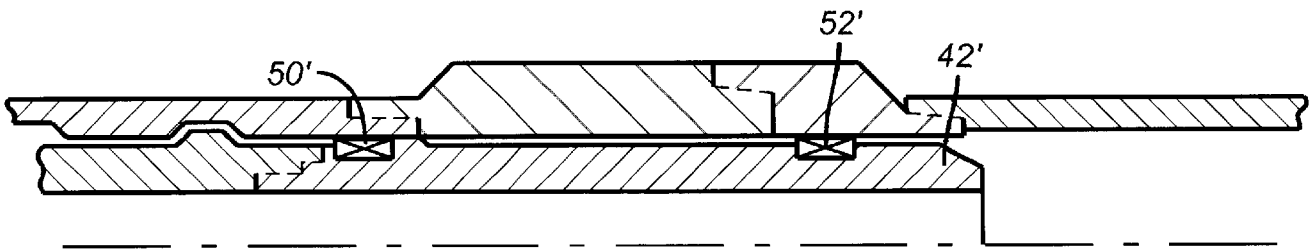
FIG. 4 is the present invention showing the installation of the insert safety valve into the SSV.

FIGS. 3 and 4 show the contrast between the prior art way of delivering an insert safety valve 44 together with a spacer 46 and a lock 48 into an existing SSV 10. The spacer 46 spaces out seals 50 and 52 into respective seal bores in the nipple adapter 54 and bottom sub 56. Those skilled in the art will appreciate that a penetrating tool penetrates into the hydraulic control system of the SSV 10 before the seals 50 and 52 are inserted to straddle such penetration such that the original control line can serve to actuate the piston in the insert safety valve 42. With the prior art installation shown in FIG. 3 the insert safety valve 42 is positioned below the seals 50 and 52 such that the maximum pressure that the housing of insert safety valve 42 is exposed to is the internal pressure in the tubing. In contrast, the installation in FIG. 4 eliminates the spacer 46 putting the seals 50' and 52' right on the insert safety valve 42'. When dealing in very large sizes of insert safety valves 42' the spacer would add significant weight, which could make the entire assembly too heavy to deliver by standard wireline rigs. Additionally, the length of the assembly may be such that it will not fit into a standard lubricator if the spacer 46 is fitted. The additional length can also present a sticking problem in a well that is highly deviated. As a result of putting the seals directly on the insert safety valve 42' and eliminating the spacer 46 the inner wall 16 of the valve 42' is subject to additional force in excess of the pressure in the tubing. This is because control line pressure now can act on the housing 12 where in the FIG. 3 installation, due to spacer 46, control pressure was not exerted on the housing.

Those skilled in the art will now appreciate that the clearance 28 can be increased when the ring 38 is used to minimize or prevent binding of the flow tube 26 due to deflection of the housing 12 and more particularly inner wall 16, especially in a situation of a large insert valve, such as 42' installed in alignment with an SSV 10 in a manner shown in FIG. 4. Again, it bears emphasis that the valve shown in FIGS. 1 and 2 could be a tubing valve or an insert safety valve. The elimination of the spacer 46 and the placement of seals 50' and 52' on the insert valve 42' lightens and shortens the assembly facilitating its insertion with standard wireline and lubricator equipment. The enlarged volume adjacent ring 38 acts as a receptacle and minimizes the tendency of sand or grit to bridge and prevent smooth operation of the flow tube 26.

It is to be understood that this disclosure is merely illustrative of the presently preferred embodiments of the invention and that no limitations are intended other than as described in the appended claims.

I claim:

1. A safety valve for downhole use, comprising:

a housing, comprising a flow passage therethrough;

piston movably mounted in said housing and connected to a flow tube for moving the flow tube in said housing to operate the valve;

said flow tube defining a clearance in said flow passage; and a particulate retention device spanning said clearance;

said particulate retention device comprises a ring;

said ring is mounted in a groove;

said groove is sufficiently deep so that flexing of said housing will not bring an outer diameter of said ring in contact with a bottom of said groove.

2. The valve of claim 1, wherein:

said groove is disposed in said housing.

3. The valve of claim 1, wherein:

said groove is disposed in said flow tube.

4. The valve of claim 1, wherein:

said ring is split to facilitate mounting in said groove.

5. The valve of claim 1, wherein:

said clearance is enlarged adjacent said particulate retention device.

6. The valve of claim 5, wherein:

said enlargement is created by a recessed surface on said housing.

7. The valve of claim 4, wherein:

said ring is split in a plane intersecting the longitudinal axis of said housing.

8. The valve of claim 1, wherein:

said housing further comprises a pair of straddle seals to allow said housing to be sealingly inserted into an existing tubing safety valve without a spacer.

9. An insert safety valve for insertion and operation through a tubing safety valve, said tubing safety valve further comprising a nipple adapter and a bottom sub having an internal bore, and a control system passage with an access opening provided from said control system into said bore in anticipation of insertion of said insert safety valve, said insert valve comprising:

a valve housing having a pair of seals thereon positioned to engage said nipple adapter and said bottom sub in said bore of the tubing safety valve and straddle said opening, without the use of a spacer.

10. The insert safety valve of claim 9, wherein:

said housing further comprises a flow passage therethrough;

a piston movably mounted in said housing and connected to a flow tube for moving the flow tube in said housing to operate the valve;

said flow tube defining a clearance in said flow passage; and a particulate retention device spanning said clearance.

11. The valve of claim 10, wherein:

said particulate retention device comprises a ring.

12. The valve of claim 11, wherein:

said ring is mounted in a groove.

13. The valve of claim 12, wherein:

said groove is disposed in said housing.

14. The valve of claim 10, wherein:

said clearance is enlarged adjacent said particulate retention device.

15. The valve of claim 12, wherein:

said groove is sufficiently deep so that flexing of said housing will not bring an outer diameter of said ring in contact with a bottom of said groove.

* * * * *